US010443836B2

(12) United States Patent
Baum et al.

(10) Patent No.: US 10,443,836 B2
(45) Date of Patent: Oct. 15, 2019

(54) CIRCULATING FLUIDIZED BED APPARATUS

(71) Applicant: DOOSAN LENTJES GMBH, Ratingen (DE)

(72) Inventors: Alexander Baum, Meerbusch (DE); Martin Tewiele, Duisburg (DE); Martin Gajsek, Dortmund (DE)

(73) Assignee: DOOSAN LENTJES GMBH, Ratingen (DE)

( * ) Notice: Subject to any disclaimer, the term of this patent is extended or adjusted under 35 U.S.C. 154(b) by 77 days.

(21) Appl. No.: 15/579,028

(22) PCT Filed: Sep. 7, 2016

(86) PCT No.: PCT/EP2016/071116

§ 371 (c)(1),
(2) Date: Dec. 1, 2017

(87) PCT Pub. No.: WO2018/046082

PCT Pub. Date: Mar. 15, 2018

(65) Prior Publication Data

US 2018/0306434 A1 Oct. 25, 2018

(51) Int. Cl.
*F22B 31/00* (2006.01)
*C10J 3/56* (2006.01)
(Continued)

(52) U.S. Cl.
CPC ..... *F22B 31/0007* (2013.01); *C10J 3/56* (2013.01); *F22B 37/24* (2013.01); *F23C 10/10* (2013.01);
(Continued)

(58) Field of Classification Search
CPC ..... F22B 31/0007; F23C 10/10; F23C 10/18; F23C 10/20
See application file for complete search history.

(56) References Cited

U.S. PATENT DOCUMENTS 3,951,108 A 4/1976 Rees
4,137,967 A * 2/1979 Hirschle ..... F28F 9/013 122/510
(Continued)

FOREIGN PATENT DOCUMENTS

CN 87103862 A 5/1988
CN 1068183 A 1/1993
(Continued)

OTHER PUBLICATIONS

A Korean Office Action dated Feb. 20, 2019 in connection with Korean Patent Application No. 10-2017-7030569 which corresponds to the above-referenced U.S. application.
(Continued)

*Primary Examiner* — Nathaniel Herzfeld
(74) *Attorney, Agent, or Firm* — Invenstone Patent, LLC

(57) ABSTRACT

A circulating fluidized bed apparatus, comprising a circulating fluidized bed furnace 10 with an outer furnace wall 10*r* and at least one heat exchange chamber 20, which is friction-locked to a section of the outer furnace wall 10*r*, as well as a platform PL which extends horizontally and at a distance to an upper ceiling 10*c* of said heat exchange chamber 20, wherein the heat exchange chamber 20 is further supported by at least one leverage 50, which is arranged onto said platform PL and extends from a first end 50*f*, pivotally mounted to the outer furnace wall 10*r*, away from said furnace wall 10*r* to a second end 50*s*, and a fastener 60 extending downwardly from said second end 50*s* of said leverage 50 to a part of the heat exchange chamber 20 offset the outer furnace wall 10*r*.

13 Claims, 1 Drawing Sheet

(51) Int. Cl.

| | |
|---|---|
| ***F22B 37/24*** | (2006.01) |
| ***F23C 10/10*** | (2006.01) |
| ***F23C 10/18*** | (2006.01) |
| ***F28F 9/007*** | (2006.01) |
| ***F28D 13/00*** | (2006.01) |
| ***F23C 10/20*** | (2006.01) |

(52) U.S. Cl.

CPC ..... *F23C 10/18* (2013.01); *F23C 10/20* (2013.01); *F28D 13/00* (2013.01); *F28F 9/007* (2013.01); *F28F 2265/26* (2013.01)

(56) References Cited

U.S. PATENT DOCUMENTS

| | | | | | |
|---|---|---|---|---|---|
| 4,716,856 | A * | 1/1988 | Beisswenger | B01J 8/0055 | 110/245 |
| 4,896,717 | A * | 1/1990 | Campbell, Jr. | F22B 31/0084 | 110/245 |
| 4,972,806 | A * | 11/1990 | Marsault | F22B 37/207 | 122/510 |
| 5,040,492 | A * | 8/1991 | Dietz | F22B 31/0084 | 110/245 |
| 5,042,452 | A * | 8/1991 | Dubreuil | F23C 3/002 | 122/510 |
| 5,342,016 | A * | 8/1994 | Marsault | F22B 37/207 | 248/610 |
| 5,682,828 | A * | 11/1997 | Phalen | F23C 10/10 | 110/245 |
| 5,840,258 | A | 11/1998 | Hyppanen | | |
| 6,305,330 | B1 | 10/2001 | Darling | | |
| 2011/0226195 | A1* | 9/2011 | Hansen | F23C 10/10 | 122/4 D |

FOREIGN PATENT DOCUMENTS

| | | | |
|---|---|---|---|
| CN | 1088479 | A | 6/1994 |
| CN | 101438099 | A | 5/2009 |
| GB | 1 075 104 | A | 7/1967 |
| JP | S6456134 | A | 3/1989 |
| JP | H08-503290 | A | 4/1996 |
| KR | 10-0597883 | B1 | 7/2006 |

OTHER PUBLICATIONS

A Chinese Office Action dated Feb. 2, 2019 in connection with Chinese Patent Application No. 201680024213.5 which corresponds to the above-referenced U.S. application.

* cited by examiner

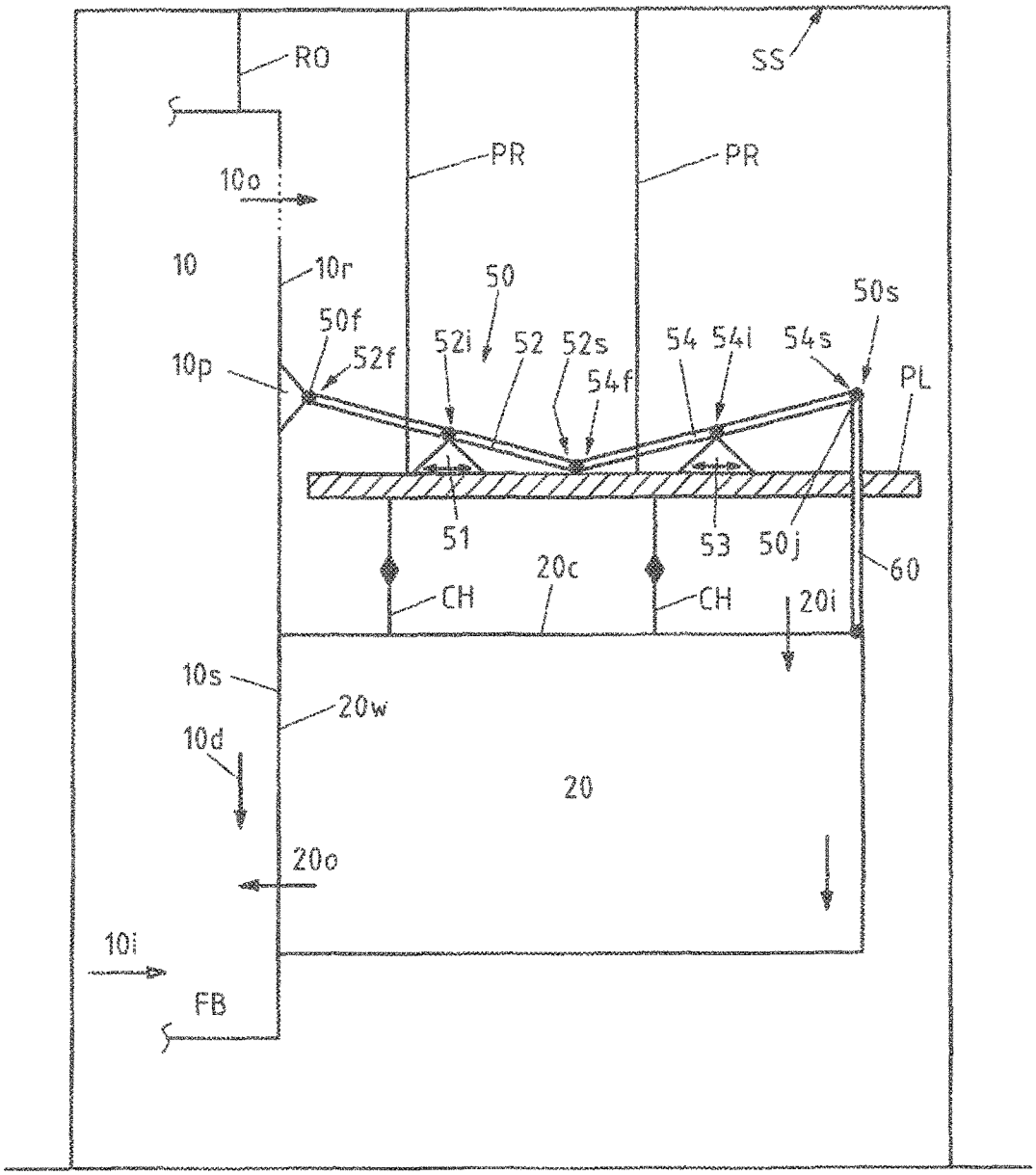
RO
SS
PR
PR
10o
10
10r
50
50s
50f
52i
52
52s
54
54i
54s
10p
52f
54f
PL
51
53
50j
60
20c
CH
CH
20i
10s
20w
10d
20
20o
10i
FB

CIRCULATING FLUIDIZED BED APPARATUS

CROSS REFERENCE TO RELATED APPLICATIONS

This application is a National Stage of International Application No. PCT/EP2016/071116 filed Sep. 7, 2016, the contents of all of which are incorporated herein by reference in their entirety.

The invention relates to so-called Circulating Fluidized Bed Apparatus (CFBA), which main components are:

A so-called Circulating Fluidized Bed Furnace (Reactor)—CFBF—, designed as a combustor, incineration reactor, boiler, gasifier, steam generator etc. as disclosed—i.a.—in U.S. Pat. No. 6,802,890 B2. In a typical CFBF gas (air) is passed through a permeable grate-like bottom area of the furnace (so-called air plenum), which grate (grid) supports a circulating fluidized bed of particulate material, the so-called incineration charge, mostly including a fuel-like material such as coal, sand etc. In typical applications aeration is achieved by corresponding nozzles, feeding air and/or gas into the particulate material present within the furnace space. The aerated particulate material/fuel mixture (air plenum) allows to promote the incineration process and effectivity.

The outer walls of the furnace, which define the combustion chamber (reaction chamber), are usually so-called tube walls, comprising welded tubes with or without fins in between. In operation a heat transferring fluid like water and/or steam is fed through said tubes/pipes of said furnace walls in order to cool the same and to transfer heat therefrom for further purposes.

The CFBF typically has at least one outlet port at its upper end, via which a mixture of gas and solid particles, exhausted from the reactor, may flow into at least one associated separator.

The separator, for example a cyclone separator, serves to separate solid particles (the particulate material, including ash) from said gas. A typical design of such a separator is disclosed in U.S. Pat. No. 4,615,715. Again the outer walls of the separator can be designed with hollow spaces to allow water flowing through.

While the gas is extracted from the separator and fed into subsequent installations of the plant, there are means for the transfer of said separated solid particles out of the separator and into at least one heat exchange chamber, often designed as a Fluidized Bed Heat Exchanger (FBHE), via a corresponding inlet port of said heat exchange chamber. These means may be ducts/pipes/channels or the like. As far as reference is made in the following to an FBHE this refers to a preferred heat exchange chamber, but includes all types of heat exchangers suitable for that purpose, independently of whether constructed as a superheater etc.

A syphon along the way from the separator to the CFBF and/or heat exchanger to allow decoupling of pressure (fields) between separator and CFBF.

The at least one heat exchange chamber allows to use the heat, provided by the particulate material, for generating power, for example to heat up and increase the pressure of a steam transported as a heat transfer medium via tubes or the like, through said heat exchanger and further to turbines or the like.

Typically the heat exchange chamber is equipped with at least one outlet port, being part of return means, in order to transport at least part of the solid particles out of the heat exchanger and back into the Circulating Fluidized Bed Furnace CFBF.

U.S. Pat. No. 5,840,258A discloses a design of such CFBA, wherein the CFBF and the FBHE have been integrated closely together; in other words: FBHE and CFBF have a common wall (tube wall). In operation, i.e. under temperature load, this design provides the advantage of close (similar) temperatures in both units and thus, minimizes any thermal stresses between both units.

Indeed these temperature expansions and temperature stresses are a major problem in such installations. The thermal expansion of a CFBF of a height of ca. 35 to 50 m may range from 0.1 m to 0.3 m and may cause serious stresses within the furnace walls, independently of whether the furnace is bottom supported (according to U.S. Pat. No. 5,840,258A) or top-supported (suspended), as shown in U.S. Pat. No. 6,305,330B1.

It is an object of the invention to provide a compact design for a circulating fluidized bed apparatus and in particular for its combustor (furnace) in combination with at least one associated unit, in particular a heat exchange unit.

The invention is based on the following findings:

A compact design may be realized by bringing associated units of the CFBA as close as possible or even better to fix one unit to another (as known from U.S. Pat. No. 5,840,258), but any such friction-locked arrangement of adjacent/associated units causes serious structural problems in view of the extreme weights/loads of such units.

A generic heat exchanger of a CFBA has a size of for example 5×5×5 m and a corresponding weight of 100.000 kg in an empty state (hereinafter referred to as basic load). Additional loads (hereinafter called variable load) by the solid material transported through said heat exchanger vary strongly and may be in a range of up to 100.000 kg or more.

The (outer) furnace wall, to which the heat exchanger may be friction-locked, typically a so-called tube wall, cannot withstand/compensate such high and variable loads unless constructed as a "castle-wall", being unacceptable in view of costs and the thermal conditions of a CFBA. The thermal expansions/constrictions mentioned above cause further structural problems.

In other words: The extreme forces and moments, caused by a heat exchange unit which is friction-locked (for example welded) to a conventional furnace wall (like a tube wall) cannot be compensated yet in an economically and mechanically acceptable way.

The invention discloses a technical solution for this problem and furthermore a technically relatively simple construction, by further providing at least one structural element, by which the heat exchanger is mechanically linked to the furnace wall, which structural element allows to compensate any such loads, caused by the heat exchanger and/or the material passing therethrough, at least partially.

In its most general embodiment the invention relates to a circulating fluidized bed apparatus, comprising a circulating fluidized bed furnace with an outer furnace wall and at least one heat exchange chamber, which is friction-locked to a section of the outer furnace wall, as well as a platform, which extends horizontally and at a distance to an upper ceiling of said heat exchange chamber, wherein the heat exchange chamber is further supported by at least one leverage, which is arranged onto said platform and extends from a first end, pivotally mounted to the outer furnace wall, away from said furnace wall to a second end, and a fastener, extending downwardly from said second end of said leverage to a part of the heat exchange chamber offset the outer furnace wall.

In other words: The structural element between furnace wall and heat exchanger (and/or similarly to any other unit which is fixedly secured to the outer furnace wall and thus follows any expansions/contractions of the furnace wall under temperature load during operation, for example a syphon system) comprises a leverage (a system of cooperating levers/arms), which serves to compensate such tolerances, and a fastener, which is fixed (coupled) to said leverage and thus follows any movements of the leverage, in particular movements of the second end of the leverage to which said fastener is hingedly secured. The platform serves to provide a basis for mounting said levers and is mostly structurally independent of the other units of the CFBA.

The leverage allows to provide a system which transmits vertical movements, caused by the furnace wall, for example a vertical downward movement of the furnace wall, and thus a downward movement of the first end of the leverage (or its first lever respectively) into a downward movement of the second end of the leverage by tilting (turning) the corresponding levers, which are hinged to each other, in different directions by their corresponding bearings. Obviously the system works analogously in the other vertical direction (vice versa).

This transmission may be 1:1, for example in case of levers of identical design and the arrangement of a pivot bearing (swivel) for each lever in the middle of its axial length. The transmission rate may also be set to another ratio, if requested, for example by providing levers (arms, bars) of different length or displacements of the lever bearings onto said static platform.

Therefore the platform should be constructed as an independent item and in a way to provide a defined and rigid support for the leverage and the fastener respectively.

The structural element "absorbs" all (additional) forces and moments, which have not been absorbed by the furnace wall, to which the heat exchanger is fixedly secured for example by welding.

Insofar the first end of the structural element (leverage) is fixed to the furnace wall at a vertical distance above the heat exchanger, while it is important for the fastener being affixed to the heat exchanger at a horizontal distance to the furnace wall. The fastener may be connected to a vertically extending wall of the heat exchanger, for example its outer wall, being the wall opposite to the furnace wall, to which the heat exchanger is mounted.

Further embodiments of the CFBA are characterized by one or more of the following features, which can be realized individually or in arbitrary combinations if not explicitly excluded or technically absurd:

A favorable construction of the leverage comprises

- a first lever, a first end of which is pivotally mounted to the outer furnace wall, a second end of which is hinged to a second lever and an intermediate section of which is pivotally mounted in a pivot bearing, arranged onto said platform.
- a second lever, a first end of which is hinged to the second end of first lever, a second end of which is hinged to the fastener, and an intermediate section of which is pivot-mounted in a pivot-bearing arranged onto said platform.

The arrangement of levers (leverage), which are interconnected by hinges, may comprise more than two levers (bars, arms), for example four or six in a row.

The first end of the leverage, being the end connected to the furnace, may be pivotally mounted in pivot bearing (swivel), which is fixed to the outer furnace wall. This pivot bearing follows any movements of the furnace wall. Therefore: in a downward movement the corresponding lever is then tilted by the pivot bearing, arranged onto the platform, and the second end of the first lever moves upwardly.

As a consequence: The first end of the second lever, which is hinged to the second end of the first lever, moves up as well, thus causing the second end of the second lever to move downwardly, while the second lever as such is tilted by its corresponding pivot bearing, fitted onto the platform.

Finally: The fastener, fixed to the second end of the second lever, transmits said downward movement of the fastener to the heat exchanger, to which the fastener is fastened by its lower end, while keeping the stress-relief (german: Zugentlastung) for the heat exchanger.

According to one embodiment the second end of the leverage comprises a pivot joint (hinge, joint), coupled to the fastener.

The fastener itself may be a bar, a rod, a strut or a hinge, allowing to compensate the tensile forces as well as compressive forces, caused for example by the heat exchanger and its load and/or any constant hangers.

Another embodiment is characterized by at least one of the pivot bearings of the first and second levers being a floating bearing, which allows movement of the pivot bearing in a horizontal direction (thus the movement is substantially perpendicular to the section of the furnace wall to which the heat exchange chamber is friction-locked). This avoids any stresses in said bearing during tilting of the corresponding lever. Insofar all said lever bearings should be floating bearings (also called friction bearings or journal bearings) in an optimized embodiment.

The platform can be realized as one or more bars, as a scaffolding or the like. The main task of the platform is to provide a defined and rigid structure for the leverage and the bearings, mounted onto the platform.

The platform may be autarc, i.e. part of a structure which is independent from the CFBA. It may be a scaffold of corresponding structural integrity.

The lower end of the fastener may be hinged to any part of the heat exchanger, offset the furnace wall, for example to the ceiling of the heat exchange chamber or to a section of the heat exchanger chamber adjacent to said ceiling.

The lower end of the fastener and/or the second end of the leverage should be arranged at an offset to the furnace wall being larger than 50%, for example >70% or >80% or >90% of a corresponding length of the heat exchange chamber, seen in a direction perpendicular to the adjacent section of the outer furnace wall to achieve best results in compensating the extensive loads of the heat exchanger.

One or more suspensions means between the platform and the heat exchange chamber define another embodiment, wherein the suspensions means may be constant load hangers (german: Konstantlast Hanger), for example constant load springs as disclosed by www.lisega.de, defining these hangers as "transferring the working load over the whole travel area while maintaining constancy, i.e. without any considerable deviation".

These constant hangers allow compensate the basic load, but may also be used to compensate at least part of the varying load, caused e.g. by the solids passing through the heat exchanger, by a corresponding dimensioning.

The leverage/fastener arrangement primarily serves to compensate the basic load of the heat exchanger and more precisely: the leverage/fastener combination reduces the transmission of moments, caused by the weight of the heat exchanger and its position at the furnace wall, into the furnace wall.

Further suspension means may be provided, wherein at least one of the following is suspended to a rigid support structure: platform, circulating fluidized bed furnace. The support structure can be a separate structure, for example a (rigid) frame, to which the furnace and/or other units of the CFBA are suspended.

The inner wall of the heat exchange chamber can be the same (a common wall) as the section of the furnace wall to which the heat exchanger is mounted, which reduces the costs and increases the thermal efficiency of the CFBA.

The heat exchanger further features at least one inlet port and at least one outlet port (the latter to allow a re-transport of solid particles from said heat exchange chamber into said circulating fluidized bed furnace), which design and placement are not crucial here and may be realized according to known embodiments.

The invention will now be described by way of an example and reference to the attached FIGURE, which displays a schematic side view on the new CFBA.

The CFBA comprises a circulating fluidized bed furnace 10, only part of which is shown, with an inlet port 10*i* for solid materials (fuel) and a fluidized bed FB at its lower part, as well as an outlet port 10*o* for a corresponding gas/solids mixture at its upper end. The furnace 10 and its furnace chamber are defined by an outer furnace wall 10*r*, to which a heat exchange chamber 20 is friction-locked at a lower section 10*s* of the outer furnace wall 10*r*. Section 10*s* of furnace wall 10*r* and inner wall 20*w* of heat exchanger 20 are represented by one common wall and made of tubes, through which water flows, with fins extending between said tubes.

The heat exchange chamber 20 features a solids (ash etc) inlet port 20*i* at its upper end and a solids outlet port 20*o* at its lower end, allowing to re-transport the solids after having passed the heat exchanger, into the fluidized bed FB of the furnace 10.

A separator and a syphon arranged between the furnace outlet port 100 and the heat exchanger inlet port 20*i* are not displayed as known to the skilled person.

The heat exchanger 20 may be of any type and constructed according to prior art.

An independent platform PL, which extends horizontally and at a distance to an upper ceiling 20*c* of said heat exchange chamber 20, is fixed by ropes PR to a frame like support structure SS, being the same support structure SS, to which the furnace 10 is suspended by rows RO. The platform PL is arranged in a defined position between heat exchanger and leverage and provides a rigid support for a leverage.

This platform PL serves to integrate the leverage 50, which is arranged onto said platform PL and extends from a first end 50*f*, pivotally mounted (pivot bearing 10*p*) to the outer furnace wall 10*r*, away from said furnace wall 10*r* to a second end 50*s*, constructed as a pivot joint 50*j*, to allow a rod-like fastener 60 extending downwardly from said pivot joint 50*j* to a part of the heat exchange chamber 20 offset to the outer furnace wall 10*r*, namely to the very right and upper corner of said heat exchanger 20, i.e. to the ceiling 20*c* of the heat exchanger 20 offset with respect to furnace wall 10*r*. In this embodiment the fixation of the fastener 60 to the heat exchanger 20 corresponds to 100% of the length of the heat exchange chamber, seen in a direction perpendicular to the adjacent section 10*s* of the furnace wall 10*r*.

The leverage comprises a first lever 52, a first end 52*f* of which is pivotally mounted (pivot bearing 10*p*) to the outer furnace wall 10*r*, a second end 52*s* of which is hinged to a second lever 54 and an intermediate section 52*i* of which is pivotally mounted in a pivot bearing 51, arranged onto said platform PL.

The leverage 50 further comprises this second lever 54, a first end 54*f* of which is hinged to the second end 52*s* of first lever 52, a second end 54*s* of which is hinged to the fastener 60, and an intermediate section 54*i* of which is pivot-mounted in a pivot-bearing 53, arranged onto said platform PL at a horizontal distance to pivot bearing 51.

The fastener 60 connects the leverage 50 and the heat exchanger 20.

Each of said pivot bearings 51, 53 is a floating bearing, which allows to move on said platform PL in a horizontal direction as will be described hereinafter.

A number (here: six) constant hangers CH are arranged—at a distance to each other—between platform PL and ceiling 20*c* of heat exchanger chamber 20, being responsible for basic and varying loads of the heat exchanger chamber 20.

In a position as displayed in the FIGURE, the following may happen under thermal load of the apparatus:

The suspended furnace 10 (its outer wall 10*r* respectively) expands and thus outer wall 10*r* moves downwardly (arrow 10*d*). Simultaneously:

- pivot bearing 10*p* moves downwardly, urging lever 52 to tilt (around pivot bearing 51,
- the second end 52*s* of lever 52 moves upwardly and the same does the first end 54*f* of second lever 54, as both ends (52*s*, 54*f*) are coupled by a hinge,
- in view of the arrangement of pivot bearing 53, lever 52 tilts such that its second end 54*s* moves downwardly and the same does fastener 60.

As the two levers 52, 54 are of identical length and shape and both pivot bearings 51, 53 are arranged just in the middle of the axial length of both levers 52, 54, the lower end (hinge) of said fastener 60 lowers by the same distance as pivot bearing 10*p* does and insofar no additional stresses are initiated.

At the same time the system reduces or even avoids excessive moments being transmitted into the furnace wall 10*r*/10*s*.

In view of the turning/tilting movement of both levers 52, 54, causing a movement perpendicular to the outer furnace wall 10*r*, both bearings 51, 53 are floating bearings, which allow such horizontal displacement.

The invention claimed is:

1. A circulating fluidized bed apparatus, comprising a circulating fluidized bed furnace (10) with an outer furnace wall (10*r*) and at least one heat exchange chamber (20), which is friction-locked to a section of the outer furnace wall (10*r*), as well as a platform (PL) which extends horizontally and at a distance to an upper ceiling (20*c*) of said heat exchange chamber (20), wherein the heat exchange chamber (20) is further supported by at least one leverage (50), which is arranged onto said platform (PL) and extends from a first end (50*f*), pivotally mounted to the outer furnace wall (10*r*), away from said furnace wall (10*r*) to a second end (50*s*), and a fastener (60) extending downwardly from said second end (50*s*) of said leverage (50) to a part of the heat exchange chamber (20) offset the outer furnace wall (10*r*).

2. The circulating fluidized bed apparatus according to claim 1, wherein the leverage comprises a) a first lever (52), a first end (52*f*) of which is pivotally mounted to the outer furnace wall (10*r*), a second end (52*s*) of which is hinged to a second lever (54) and an intermediate section (52*i*) of which is pivotally mounted in a pivot bearing (51), arranged onto said platform (PL)

b) a second lever (54), a first end (54*f*) of which is hinged to the second end (52*s*) of first lever (52), a second end (54*s*) of which is hinged to the fastener (60), and an intermediate section (54*i*) of which is pivot-mounted in a pivot-bearing (53) arranged onto said platform (PL).

3. The circulating fluidized bed apparatus according to claim 1, wherein the first end (50*f*) of the leverage (50) is pivotally mounted in pivot bearing (10*p*).

4. The circulating fluidized bed apparatus according to claim 1, wherein the second end (50*s*) of the leverage (50) comprises a pivot joint (50*j*).

5. The circulating fluidized bed apparatus according to claim 1, wherein the fastener (60) is a bar, a rod, a strut or a hinge.

6. The circulating fluidized bed apparatus according to claim 2, wherein at least one of the pivot bearings (51, 53) of the first and second levers (52, 54) is a floating bearing, which allows movement of the pivot bearing in a horizontal direction.

7. The circulating fluidized bed apparatus according to claim 1, wherein a lower end of the fastener (60) is hinged to the upper ceiling (20*c*) of the heat exchange chamber (20) or a section of the heat exchanger chamber (20) adjacent to said upper ceiling (20*c*).

8. The circulating fluidized bed apparatus according to claim 1, further comprising one or more suspension means between the platform (PL) and the heat exchange chamber (20).

9. The circulating fluidized bed apparatus according to claim 8, wherein the suspension means are constant load hangers (CH).

10. The circulating fluidized bed apparatus according to claim 1, wherein at least one of the following is suspended from a support structure (SS): platform (PL), circulating fluidized bed furnace (10).

11. The circulating fluidized bed apparatus according to claim 1, wherein the second end (50*s*) of the leverage (50) is arranged at an offset to the furnace wall (10*r*) being larger than 70% of a corresponding length of the heat exchange chamber (20), seen in a direction perpendicular to the adjacent section (10*s*) of the outer furnace wall (10*r*).

12. The circulating fluidized bed apparatus according to claim 1, wherein the outer furnace wall (10*r*) and an inner wall of the heat exchange chamber (20) represent a common wall.

13. The circulating fluidized bed apparatus according to claim 1, wherein the heat exchange chamber (20) features at least one outlet port (20*o*) and the circulating fluidized bed furnace (10) features at least one corresponding port to allow a re-transport of solid particles from said heat exchange chamber (20) into said circulating fluidized bed furnace (10).

* * * * *